US006935782B2

(12) United States Patent
Cholsaipant

(10) Patent No.: US 6,935,782 B2
(45) Date of Patent: Aug. 30, 2005

(54) BULK BAG WITH SEAMLESS BOTTOM

(76) Inventor: Natthi Cholsaipant, 134/1 Moo 7, Suanluang, Kratumban, Samutsakorn 74110 (TH)

( * ) Notice: Subject to any disclaimer, the term of this patent is extended or adjusted under 35 U.S.C. 154(b) by 92 days.

(21) Appl. No.: 10/305,494

(22) Filed: Nov. 26, 2002

(65) Prior Publication Data

US 2003/0123757 A1 Jul. 3, 2003

(30) Foreign Application Priority Data

Nov. 26, 2001 (TH) ..... 069952

(51) Int. Cl.[7] ..... B65D 33/14
(52) U.S. Cl. ..... 383/24; 386/122; 493/243
(58) Field of Search ..... 383/121, 121.1, 383/122, 119, 24; 493/231, 243

(56) References Cited

U.S. PATENT DOCUMENTS

| | | | | | |
|---|---|---|---|---|---|
| 724,316 | A | * | 3/1903 | Morris et al. | 383/18 |
| 733,542 | A | * | 7/1903 | Converse | 383/16 |
| 1,148,948 | A | | 8/1915 | Benjamin | |
| 1,148,949 | A | | 8/1915 | Benjamin | |
| 2,010,380 | A | * | 8/1935 | Schaaf | 383/121 |
| 2,415,956 | A | | 2/1947 | Mamaux | |
| 3,295,738 | A | | 1/1967 | Keuchenius et al. | |
| 3,425,472 | A | | 2/1969 | Marino | |
| 4,223,709 | A | * | 9/1980 | Myklebust | 383/7 |
| 4,521,911 | A | * | 6/1985 | Vance | 383/20 |
| 4,779,998 | A | * | 10/1988 | Wischusen, III | 383/121 |
| 4,786,192 | A | * | 11/1988 | Graves et al. | 383/119 |
| 4,830,191 | A | | 5/1989 | Dijksman | |
| 5,025,925 | A | | 6/1991 | Wiklund | |
| 5,158,369 | A | * | 10/1992 | Derby | 383/67 |
| 5,316,387 | A | | 5/1994 | Polett et al. | |
| 5,328,268 | A | | 7/1994 | Lafleur | |
| 5,468,528 | A | | 11/1995 | Schnaars et al. | |
| RE35,270 | E | * | 6/1996 | Polett | 383/24 |
| 5,538,155 | A | | 7/1996 | Hoekstra | |
| 5,785,175 | A | | 7/1998 | Cholsaipant | |
| 5,967,579 | A | * | 10/1999 | Hebert | 294/74 |
| 6,494,324 | B2 | * | 12/2002 | Ours et al. | 206/527 |

FOREIGN PATENT DOCUMENTS

| | | |
|---|---|---|
| DE | 3928054 | 2/1991 |
| EP | 0080126 | 6/1983 |
| EP | 0665175 A1 | 8/1995 |
| GB | 2161452 | 1/1986 |
| GB | 2255963 | 11/1992 |
| WO | WO 92/13781 | 8/1992 |

* cited by examiner

*Primary Examiner*—Jes F. Pascua
(74) *Attorney, Agent, or Firm*—Sheridan Ross P.C.

(57) ABSTRACT

A bulk bag is provided with a seamless bottom or base. The base is constructed of a single sheet of material which is folded at the corners thereby providing a continuous and seamless member which prevents leakage of material contained within the bulk bag as well as contamination of product within the bulk bag from the environment. An upper assembly of the bulk bag may either conform to the shape of the base, or may be of another shape as desired.

17 Claims, 4 Drawing Sheets

BULK BAG WITH SEAMLESS BOTTOM

FIELD OF THE INVENTION

The present invention relates to a flexible bag for holding bulk products, and more particularly, to a bulk bag having a seamless base which prevents leakage, avoids product contamination, and adds strength to the bulk bag.

BACKGROUND OF THE INVENTION

Bulk materials are often transported in containers such as large flexible bags. Such material may include cement, plastic, grains, and the like.

One example of a flexible bulk bag is that disclosed in U.S. Pat. No. 5,785,175. This particular bulk bag is especially adapted for lifting by the forks or tines of a fork lift. The bulk bag has a base, a plurality of sidewalls, and various forms of reinforcing members which add strength to the bulk bag.

Many flexible bulk bags are manufactured from woven plastic fabric or other plastics of a flexible and sturdy nature. One particular problem with these types of flexible bags is that when they become wet, the contents of the bag can become contaminated through the seams or stitches which hold the various parts of the bag together. Thus, although the woven or plastic fabric itself may be impermeable, problems arise when the woven plastic fabric is joined along seams or stitches. Particularly when seams or stitches are formed on the bottom surface of the bulk bag, contamination can occur because the bulk bag will make contact with the ground. Seams or stitches along the bottom surface of the bag may reduce the overall strength of the bag. Over time, the seams can deteriorate due to moisture or other environmental conditions. Even if adhesive or heat sealing is used to join sections of fabric along a bottom surface, these methods of attachment can also deteriorate over time due to material stresses experienced by the bottom surface.

SUMMARY OF THE INVENTION

The above disadvantages of the prior art are overcome by the construction of the bulk bag of the present invention. The present invention has a seamless base which prevents contamination of product contained within the bulk bag if the bulk bag becomes soaked or comes into contact with the ground or other surfaces. The present invention also provides an overlapping connection between the side panels and upstanding side edges of the seamless base. The overlapping connection adds structural integrity and strength to the bulk bag. The base has a folded construction at the corners thereby eliminating the need to connect separate pieces of the base.

Other advantages will become apparent from a review of the drawings taken along with the detailed description.

DETAILED DESCRIPTION

Figure 1:
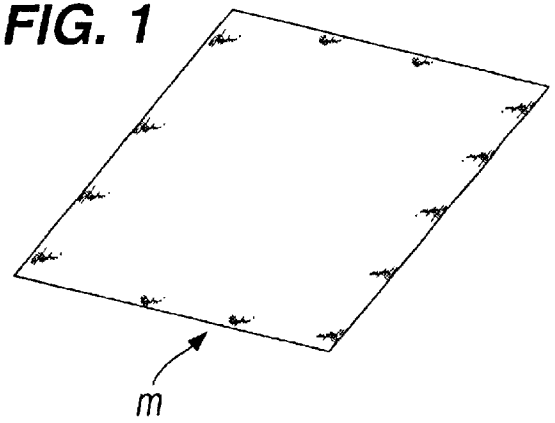
FIG. 1 is a perspective view of a single piece of material used to make the base of the flexible bag of the present invention.
Figure 2:
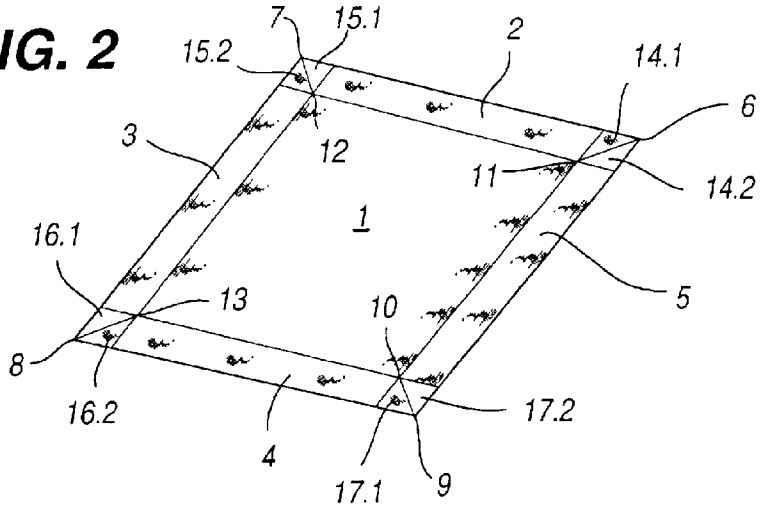
FIG. 2 is a perspective view showing the base and the fold lines incorporated on the base.
Figure 3:
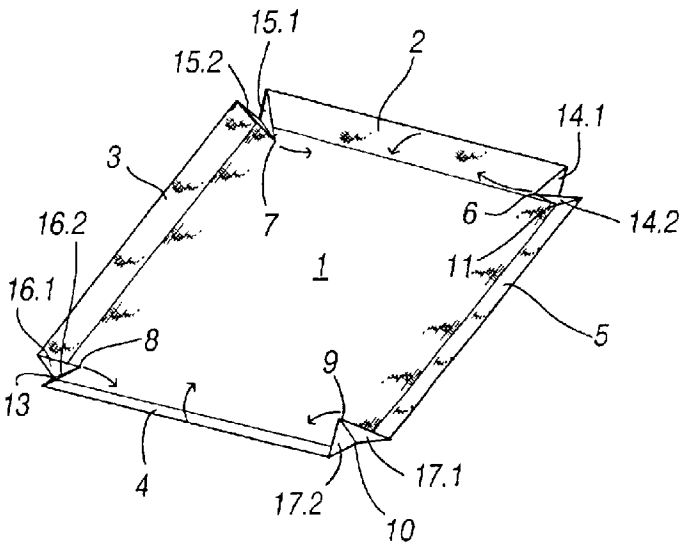
FIG. 3 is another perspective view of the base shown as being partially folded during assembly.
Figure 4:
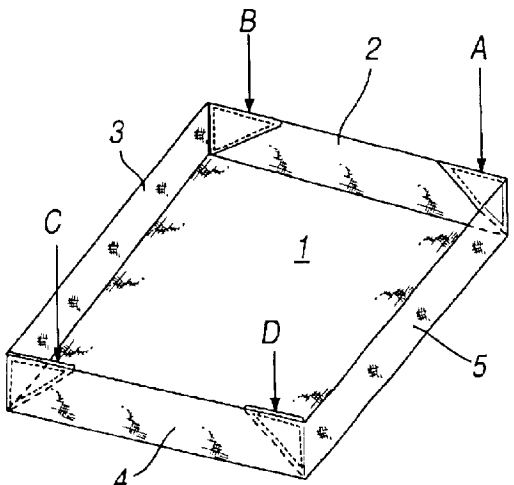
FIG. 4 is a perspective view showing the base fully folded.

FIG. 1 illustrates a single piece of material M which is used for the base of the present invention. In FIG. 2, the base 1 is shown with various fold lines which are used to fold the base for assembly. The base is defined by side edges 2, 3, 4 and 5. Corners of the base are defined at 6, 7, 8 and 9. The fold lines each intersect at intersection points 10, 11, 12 and 13. Each corner includes two fold lines which are positioned at a right angle to one another, and a third diagonal fold line extends from the intersection point to the respective corner. Additional fold lines traverse the base which form the intersection of the side edges and the bottom surface of the base. As shown in FIG. 3, in a first configuration of the base, the base is folded along the various fold lines. The fold lines at each of the corners of the base define folded sections 14.1 and 14.2, 15.1 and 15.2, 16,1 and 16.2, and 17.2 and 17.2. In this first configuration, the folded sections are folded inward towards the center of the base 1. As shown in FIG. 4, the folded sections are fully folded and then may be secured to the inner side or surface of the respective edges 2–5. Areas of connection may be designated by the folded sections located at each corner of the base, shown in FIG. 4 as connections A, B, C and D.

Figure 5:
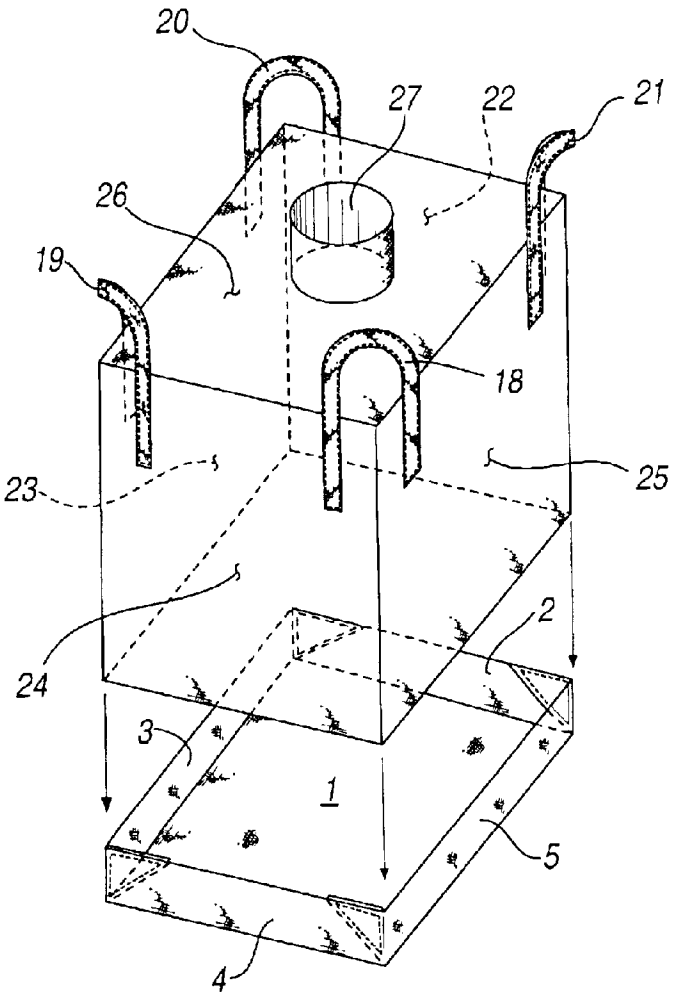
FIG. 5 is an exploded perspective view of the base prior to being attached to the sidewalls of the flexible bag.

Referring to FIG. 5, an upper assembly of the bulk bag is shown prior to connection with the base 1. The upper assembly of the bulk bag includes four side panels 22, 23, 24 and 25. The side panels are joined to one another to form a square or rectangular shaped enclosure. A top panel 26 interconnects the upper edges of the side panels. A spout 27 attaches to the top panel 26, and an opening is formed through the top panel 26 allowing the spout 27 to communicate with the interior of the enclosure. A plurality of loops may be attached to the side panels in a desired configuration allowing material handling equipment, such as a forklift, to engage the bulk bag for transport. As shown in FIG. 5, four loops are attached to the corners of the bulk bag. The loops are designated at 18, 19, 20 and 21.

Figure 6:
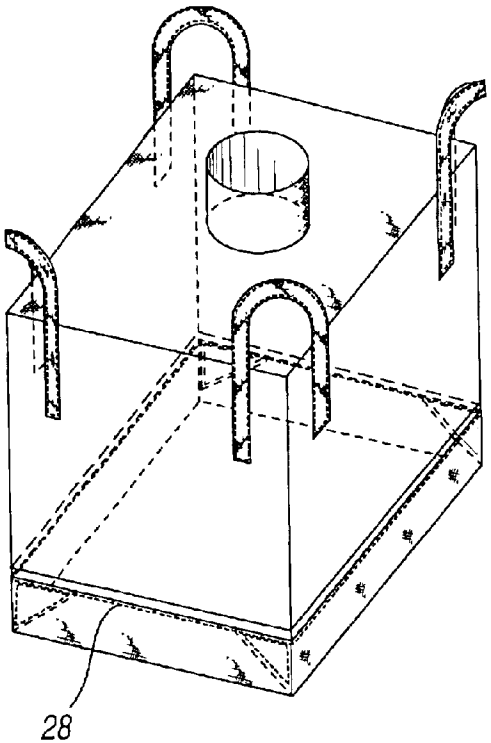
FIG. 6 is a perspective view showing the base attached to the sidewalls.

FIG. 6 shows the bulk bag fully assembled. A stitch line 28 designates the points at which the upper assembly of the bulk bag attaches to the base. As can be seen, the lower edges of the side panels overlap the upstanding side edges of the base. Although a stitch line is shown in FIG. 6, it shall be understood that other means may be used to attach the base to the upper assembly of the bulk bag such as heat sealing, adhesive, or other well known means.

Figure 7:
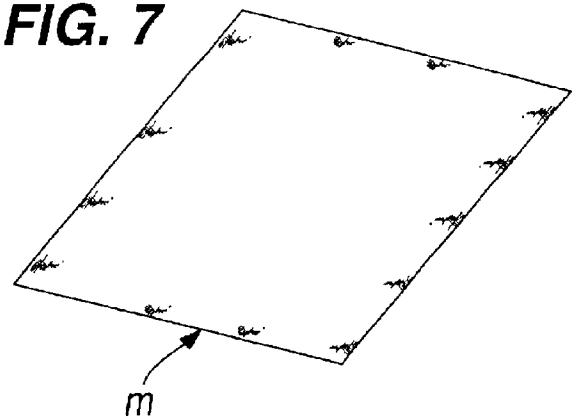
FIG. 7 is another perspective view like FIG. 1 of the base prior to being folded.

Referring to FIG. 7, the piece of material M is now shown prior to being folded in a second configuration of the base.

Figure 8:
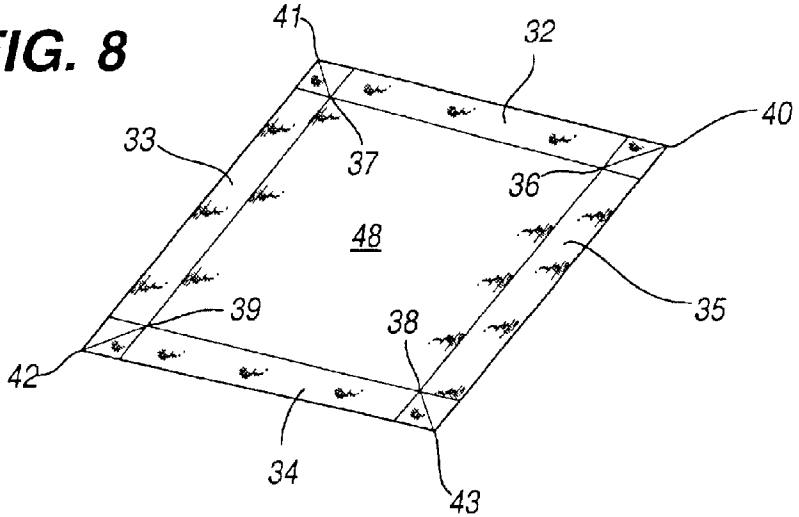
FIG. 8 is a perspective view similar to FIG. 2 showing the fold lines.

FIG. 8 is identical to FIG. 2 illustrating the various fold lines on the piece of material forming a base 48. As with the first configuration, the second configuration includes a base having side edges 32, 33, 34 and 35; intersection points at 36, 37, 38 and 39 and designated corners at 40, 41, 42 and 43.

Figure 9:
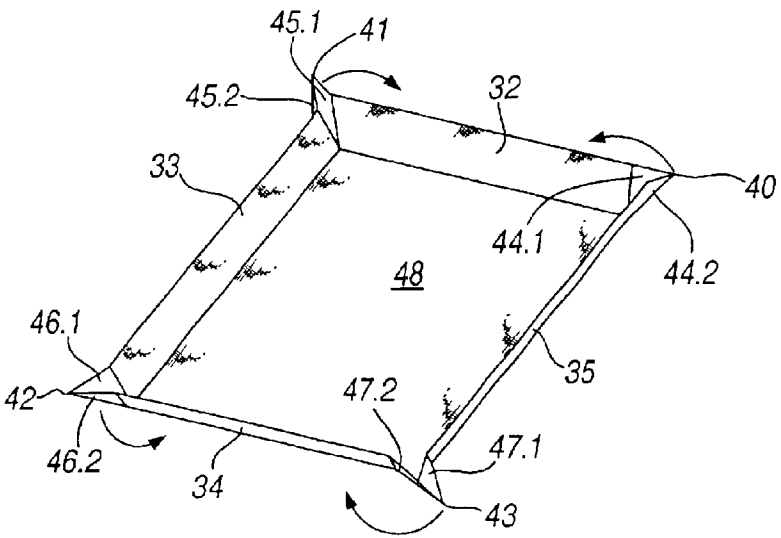
FIG. 9 shows an alternative configuration of the base, the base being shown as partially folded.

As shown in FIG. 9, the base is shown as partially assembled. In this second configuration, the folded sections are folded outward away from the center of the base 48. The folded sections are designated at 44.1 and 44.2, 45.1 and 45.2, 46.1 and 46.2, and 47.1 and 47.2.

Figure 10:
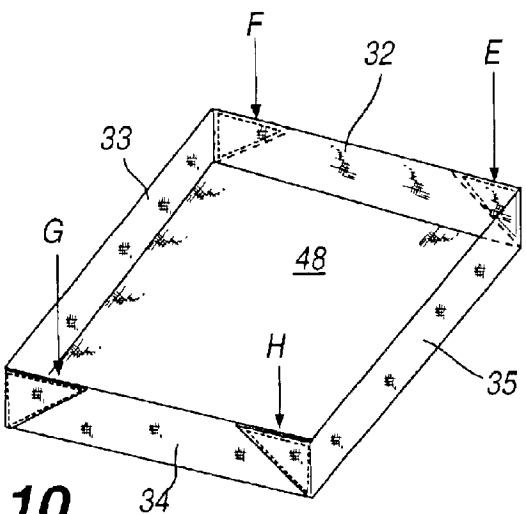
FIG. 10 shows the base being fully folded in accordance with the alternate configuration.

FIG. 10 shows the base of the second configuration fully assembled. The folded sections are secured to the outer or exterior edges of the respective side edges. The areas of connection are designated at E, F, G and H. Thus, the second configuration differs from the first configuration only in the manner in which the folded sections are folded and attached to the side edges of the base.

Figure 11:
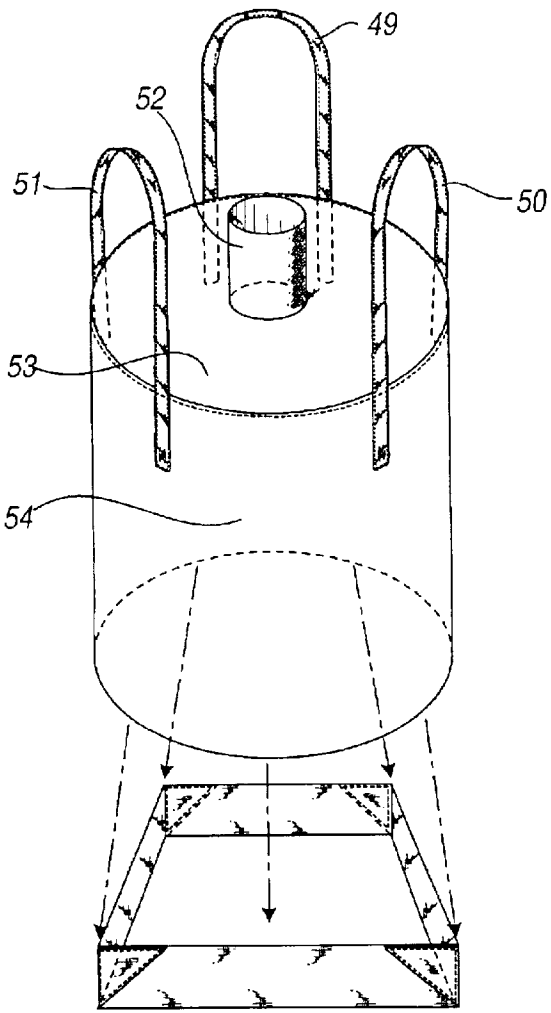
FIG. 11 is an exploded perspective view of a second embodiment of the present invention wherein a continuous sidewall is provided of a cylindrical shape.

Referring to FIG. 11, the second embodiment of the invention includes an upper assembly having a cylindrical configuration, as opposed to a square or rectangular configuration. Cylindrical body 54 forms a continuous side panel and defines an enclosure. Top panel 53 attaches to the body 54 along the upper edge thereof. A spout 52 attaches to the top panel 53. An opening is formed in the top panel 53 allowing the spout 52 to communicate with the interior of the enclosure.

Figure 12:
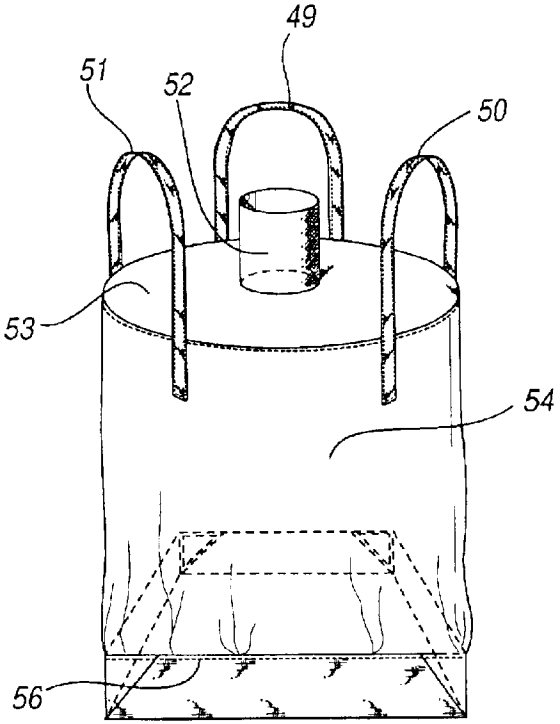
FIG. 12 is a perspective view of the second embodiment showing the cylindrical sidewall attached to the folded base of alternate configuration.

FIG. 12 shows the second embodiment fully assembled wherein stitch line 56 indicates the connection points between the upper assembly of the bulk bag and the base 48. As with the first embodiment, in lieu of stitching, other well known means may be used to attach the upper assembly to the base to include heat sealing, adhesive and the like. Because of the round configuration of the cylindrical body 54, there will be some degree of bunching or folding of material along the lower portion of the cylindrical body 54. The lower edge of the cylindrical body 54 also overlaps the upstanding side edges of the base. The circumference of the cylindrical body 54 can be sized to match the combined lengths of the side edges of the base thereby enabling a smooth and continuous connection between the upper assembly and base.

This invention has been described in reference to particular embodiments herein; however, it shall be understood that various modifications can be made which are still covered by the claims appended hereto.

What is claimed is:

1. A bulk bag comprising:

a seamless base constructed of a first single piece of material, said base having a plurality of folded side edges and folded corners, said folded corners each including a pair of folds disposed at substantially a right angle to one another, and a diagonal fold extending between the pair of folds, said pair of folds defining a corresponding pair of folded sections separated by said diagonal fold, wherein said folded sections are folded toward a center of said base and secured to a corresponding interior surface of an adjacent side edge;

an upper assembly constructed of a second piece of material including at least one continuous side panel forming an enclosure, said at least one panel having continuous upper and lower edges, said lower edge sewn to and overlapping said side edges of said base;

a top panel attached to said upper edge of said at least one side panel;

a spout attached to said top panel, and an opening formed in said top panel at said spout enabling said spout to communicate with said enclosure; and a plurality of loops attached to said at least one side panel.

2. A bag, as claimed in claim 1, wherein:

said at least one side panel is cylindrical in shape.

3. As bag, as claimed in claim 1, wherein:

said at least one side panel includes a plurality of side panels joined to one another in a desired shape.

4. A bag, as claimed in claim 1, wherein:

said at least one continuous side panel is rectangular in shape.

5. A bag, as claimed in claim 1, wherein:

said plurality of loops include four loops, said loops being spaced from one another around said at least one continuous side panel.

6. A bulk bag comprising:

a seamless base constructed of a first single piece of material, said base having a plurality of folded side edges and folded corners, said folded corners each including a pair of folds disposed at substantially a right angle to one another, and a diagonal fold extending between the pair of folds, said pair of folds defining a corresponding pair of folded sections separated by said diagonal fold, wherein said folded sections are folded away from a center of said base and secured to a corresponding exterior surface of an adjacent side edge;

an upper assembly constructed of a second piece of material including at least one continuous side panel forming an enclosure, said at least one panel having continuous upper and lower edges, said lower edge sewn to and overlapping said side edges of said base a top panel attached to said upper edge of said at least one side panel;

a spout attached to said top panel, and an opening formed in said top panel at said spout enabling said spout to communicate with said enclosure; and a plurality of loops attached to said at least one side panel.

7. A bag, as claimed in claim 6, wherein:

said at least one side panel is cylindrical in shape.

8. As bag, as claimed in claim 6, wherein:

said at least one side panel includes a plurality of side panels joined to one another in a desired shape.

9. A bag, as claimed in claim 6, wherein:

said at least one continuous side panel is rectangular in shape.

10. A bag, as claimed in claim 6, wherein:

said plurality of loops include four loops, said loops being spaced from one another around said at least one continuous side panel.

11. A method of constructing a bulk bag having a seamless base, said method comprising the steps of:

providing a first single rectangular shaped piece of material for use as a base;

delineating fold lines at each corner of the base, said fold lines including a pair of fold lines disposed at a right angle to one another, and a diagonal fold extending between the pair of folds, said pair of folds defining a pair of folded sections separated by the diagonal fold;

folding the folded sections toward a center of the base;

folding side edges of the base simultaneous with the folding of the folded sections;

securing the folded sections to an interior surface of an adjacent side edge;

providing an upper assembly constructed of a second piece of material including at least one continuous side panel, a top panel, and a spout;

attaching a lower portion of said at least one side panel by sewing to said side edges of the base, said lower portion overlapping the side edges of the base at points of attachment.

12. A method, as claimed in claim 11, further including the step of:

attaching a plurality of loops to said at least one side panel.

13. A method of constructing a bulk bag, as claimed in claim 11, wherein: said at least one continuous side panel is rectangular in shape.

14. A method of constructing a bulk bag, as claimed in claim 11, wherein:

said plurality of loops include four loops, said loops being spaced from one another around said at least one continuous side panel.

15. A method of constructing a bulk bag having a seamless base, said method comprising the steps of:

providing a first single rectangular shaped piece of material for use as a base;

delineating fold lines at each corner of the base, said fold lines including a pair of fold lines disposed at a right angle to one another, and a diagonal fold extending between the pair of folds, said pair of folds defining a pair of folded sections separated by the diagonal fold;

folding the folded sections away from a center of the base;

folding side edges of the base simultaneous with the folding of the folded sections;

securing the folded sections to an exterior surface of a corresponding adjacent side edge;

providing an upper assembly constructed of a second piece of material including at least one continuous side panel, a top panel, and a spout; and attaching a lower portion of said at least one side panel by sewing to said side edges of the base, said lower portion overlapping the side edges of the base at points of attachment.

16. A method of constructing a bulk bag, as claimed in claim 15, wherein:

said at least one continuous side panel is rectangular in shape.

17. A method of constructing a bulk bag, as claimed in claim 15, wherein:

said plurality of loops include four loops, said loops being spaced from one another around said at least one continuous side panel.

* * * * *